US009347296B2

(12) United States Patent
Faanes et al.

(10) Patent No.: US 9,347,296 B2
(45) Date of Patent: May 24, 2016

(54) LINING OF WELL BORES WITH EXPANDABLE AND CONVENTIONAL LINERS

(75) Inventors: Audun Faanes, Trondheim (NO); Halvor Kjørholt, Trondheim (NO); Torstein Vinge, Trondheim (NO)

(73) Assignee: STATOIL PETROLEUM AS, Stavanger (NO)

( * ) Notice: Subject to any disclaimer, the term of this patent is extended or adjusted under 35 U.S.C. 154(b) by 976 days.

(21) Appl. No.: 13/062,163

(22) PCT Filed: Sep. 4, 2009

(86) PCT No.: PCT/EP2009/061458

§ 371 (c)(1),
(2), (4) Date: May 16, 2011

(87) PCT Pub. No.: WO2010/026215

PCT Pub. Date: Mar. 11, 2010

(65) Prior Publication Data

US 2011/0214884 A1 Sep. 8, 2011

(30) Foreign Application Priority Data

Sep. 4, 2008 (GB) ..... 0816197.8

(51) Int. Cl.
*E21B 43/10* (2006.01)
*E21B 29/10* (2006.01)
(Continued)

(52) U.S. Cl.
CPC ..... *E21B 43/103* (2013.01); *E21B 29/10* (2013.01); *E21B 33/035* (2013.01); *E21B 33/047* (2013.01); *E21B 43/10* (2013.01)

(58) Field of Classification Search
CPC ..... E21B 43/10; E21B 43/103; E21B 43/108; E21B 33/04; E21B 33/047; E21B 33/0407; E21B 29/10; E21B 34/04; E21B 7/20
USPC ..... 175/57; 166/277, 242.9, 380, 206, 207, 166/368
See application file for complete search history.

(56) References Cited

U.S. PATENT DOCUMENTS 2,607,422 A * 8/1952 Parks ..... E21B 33/04 166/367
2,939,533 A 6/1960 Coberly
(Continued)

FOREIGN PATENT DOCUMENTS

EP 0 011 741 A1 6/1980
NO 985428 A 1/1999
(Continued)

*Primary Examiner* — Kenneth L Thompson
*Assistant Examiner* — Wei Wang
(74) *Attorney, Agent, or Firm* — Birch, Stewart, Kolasch & Birch, LLP

(57) ABSTRACT

Reducing the diameter of a well bore has many advantages. To achieve this a subsurface well bore is provided comprising one or more expandable sleeve components, preferably expandable liners (27, 271), each expandable sleeve component being fully overlapped by one or more non expandable sleeve component, preferably conventional liners (28, 29), such that the interior of the well bore is cased entirely by non expandable sleeve components (28, 29). In addition the through holes (34*a*) for downhole lines can be provided within the well head (34) rather than the tubing hanger (33). As the tubing hanger does not need to provide space for through holes and associated mounting couplings, its diameter can be reduced, thus reducing the internal diameter of the well bore by several inches.

16 Claims, 3 Drawing Sheets

(51) Int. Cl.
*E21B 33/035* (2006.01)
*E21B 33/047* (2006.01)

(56) References Cited

U.S. PATENT DOCUMENTS

| | | | | |
|---|---|---|---|---|
| 3,272,517 | A | 9/1966 | Howard et al. | |
| 3,703,929 | A * | 11/1972 | Rardin | E21B 33/10 166/302 |
| 6,047,776 | A | 4/2000 | Kiang et al. | |
| 6,196,323 | B1 | 3/2001 | Moksvold | |
| 6,283,211 | B1 | 9/2001 | Vloedman | |
| 6,394,837 | B1 | 5/2002 | Edwards et al. | |
| 6,860,329 | B1 | 3/2005 | Oosterling | |
| 7,066,284 | B2 * | 6/2006 | Wylie et al. | 175/65 |
| 8,443,899 | B2 * | 5/2013 | June et al. | 166/368 |
| 2004/0079532 | A1 | 4/2004 | Allen et al. | |
| 2004/0256112 | A1 | 12/2004 | Harrall et al. | |
| 2005/0103525 | A1 | 5/2005 | Sangesland | |
| 2005/0127671 | A1 * | 6/2005 | Ellington | E21B 17/02 285/382 |
| 2007/0187146 | A1 | 8/2007 | Wylie et al. | |
| 2008/0121400 | A1 | 5/2008 | Allen | |
| 2009/0032241 | A1 | 2/2009 | Allen et al. | |

FOREIGN PATENT DOCUMENTS

| | | | |
|---|---|---|---|
| SU | 1 627 669 | A1 | 2/1991 |
| WO | WO 97/45624 | A1 | 12/1997 |
| WO | WO 03/042488 | A2 | 5/2003 |
| WO | WO 03/042489 | A2 | 5/2003 |
| WO | WO 03/056125 | A3 | 7/2003 |
| WO | WO 03/076762 | A1 | 9/2003 |

* cited by examiner

LINING OF WELL BORES WITH EXPANDABLE AND CONVENTIONAL LINERS

This invention relates to providing a small bore wellhead, which has several benefits, particularly in relation to sub sea wells.

When drilling for oil or gas it is necessary to case the resulting well bore in order to strengthen the bore and to prevent fluids from leaking into or out of the bore. This is achieved by the use of sleeve components, which cover and support the interior wall of the well bore. Due to differences in pore and formation pressures at different subsurface depths, it is often necessary to case the well in stages while the bore is drilled rather than providing a single sleeve component after the desired depth has been reached.

Standard well bore construction methodology requires the drilling of an initial large diameter hole, which is then cased with a sleeve component. This first sleeve component is referred to as a surface casing. Drilling then continues at a smaller diameter such that, in due course, a sleeve component can be passed down through the upper well bore in order to case the lower, narrower section. Further well sections are drilled in a similar fashion, such that the resulting borehole has a diameter which decreases in a stepped manner.

In order to enable a reasonable number of sleeve components to be fitted within the bore hole, the initial diameter of the well bore must be relatively large. For example, a standard well head (the part of the well located at the surface of the well bore) has an internal diameter of approximately 18¾". This allows for a succession of narrower sleeve components (also referred to as strings) to be positioned within the well bore whilst still enabling a suitably wide production tubing to be run down the completed well for transporting oil and gas from the reservoir. In modern systems production tubing having an inner diameter of around 6" and an outer diameter of approximately 7" is standard, although smaller diameter tubing is occasionally used.

Two main types of sleeve component exist, namely casings and liners. Throughout this specification the following terminology will be applied. A "casing" refers to any sleeve component for sealing the interior of a well bore which extends from and is attached to the top of the well bore, i.e. the well head.

A "liner" on the other hand refers to a sleeve component which does not extend from the top of the well bore but which is instead attached to another sleeve component positioned within the well bore above the liner, referred to as a previous sleeve component.

Being able to reduce the diameter of the well bore would allow the use of smaller drill bits, which would result in less drill cuttings, less mud consumption and less casing/liner steel as well as faster drilling times.

In addition, in relation to sub-sea wells, a well head system with a smaller inner diameter would facilitate the use of a marine riser with a smaller inner diameter. The marine riser is a string of pipe stretching between the well head on the sea bed and a ship or rig. A small diameter riser is beneficial for withstanding high pressures and attracts less hydrodynamic forces, and therefore is a key factor in the design of high pressure risers and blow out preventors (BOP). In addition such risers take up less space, are easier to handle and allow the manufacture of smaller associated parts.

WO03/076762 discloses a well casing system in which a set of telescopic liners is pre-installed at a point below the drilling riser and well head. This allows the liners to have a larger diameter than the well head as the liners do not need to be fed through this component. Instead, the initial part of the well bore is drilled in a conventional manner. The surface casing and well head are then installed together with a set of telescopic liners attached to the surface casing. As the remainder of the well is drilled the pre-installed liners can be lowered to case newly drilled sections of bore hole.

While this design allows a narrow wellhead and drilling riser to be used, as the liners are conventional widths it does not result in any reduction in drilling mud, cuttings, drill time etc. Further the use of pre-installed liners increases the complexity and decreases flexibility of the system. Once the liners have been pre-installed it is not possible to replace these should it become apparent during drilling that a different length or width of liner would be more suitable.

Both casings and liners can be expandable or non-expandable, with the latter being referred to as conventional. Whereas conventional sleeve components are intended to retain their diameter, expandable sleeve components are designed to be deformable from a first diameter to a second, larger diameter. Expandable sleeve components are typically lowered into position within the well bore while at their first diameter and are then expanded to their second diameter in order to support the wall of the well bore. Conventional sleeve components on the other hand are positioned in the well when already at their useable diameter, i.e. the diameter at which they will provide support to the well bore.

Both conventional sleeve components and expandable sleeve components may comprise a first section having a first diameter and a second section have a second diameter different to the first diameter. In the case of expandable sleeve components the first diameter may be the unexpanded diameter or both the first and second diameters may be obtained through expansion from an original diameter. The creation of the first and second diameters of conventional sleeve components occurs before insertion into the well bore.

WO2003/042489 discloses a monobore well, in which a series of expandable liners are used. These liners are constructed such that, once in position within the well, their diameter can be increased. This is done, for example, by running a die member through the liner. The die member has a diameter equal to that of the desired internal diameter of the liner, such that the liner is deformed and expanded to the desired diameter. The expansion causes a forced fit with the previous liner and allows the entire well bore to be cased in liners of the same expanded diameter.

Given the deformable nature of expandable liners there are problems concerning their pressure integrity after expansion. During the expansion process changes in liner thickness, and the potential for damage to couplings and threaded sections, results in difficulties ensuring that full pressure integrity and air tight sealing is achieved. This results in a slower and more costly well casing procedure as checks need to be made and any weak areas reinforced. The same difficulties exist when using expandable casings.

Therefore the problem remains within the industry of providing a narrow well bore and marine riser in combination with a sufficient number of sleeve components such that variations in formation pressure can be accounted for during drilling. Although monobores can in principle achieve this, in practice there are challenges regarding the pressure integrity of such systems.

An objective of at least a preferred embodiment of the invention is to enable reduction of the bore diameter and the inner diameter of the well head without reducing the inner diameter of the production tubing. A further objective of at least a preferred embodiment of the invention is to avoid problems related to providing gas tight, high pressure resistant expandable liner systems.

According to one aspect of the present invention there is provided a subsurface well bore comprising one or more expandable sleeve components, each expandable sleeve component being fully overlapped by one or more non expandable sleeve component such that the interior of the well bore is cased entirely by non expandable sleeve components.

Viewed from another aspect the present invention provides a method of drilling a subsurface well bore comprising the steps of drilling a well section, casing said well section with an expandable sleeve component, such that the expandable sleeve component forms an intermediate, temporary support of the well bore, drilling a further well section, and casing said further well section with a non expandable sleeve component which fully overlaps the expandable sleeve component and the further well section.

In accordance with the present invention the problem of providing a gas tight high pressure expandable sleeve component system is overcome by using the expandable sleeve components only as temporary, intermediate support for the well bore. These components are used to support sections of the well during drilling, but are overlapped by non expandable sleeve components prior to completion of the well.

The present invention therefore utilises the benefits of expandable sleeve components during drilling without reducing the pressure integrity of the completed well. The use of an expandable sleeve component to case a well section prevents the need for a decrease in well bore diameter. For example, in a well bore comprising two expandable sleeve components and two non-expandable sleeve components, the diameter of the well bore will only need to be reduced twice as opposed to the four times that would be necessary if all the sleeve components were non expandable. This enables the initial diameter of the well bore, and hence the well head and riser, to be reduced without reducing the pressure integrity of the completed well.

Although it is possible for all but one of the sleeve components to be an expandable sleeve component, with a single, non expandable sleeve component overlapping all of these, it is preferable for each expandable sleeve component to be overlapped by a different non expandable sleeve component. This means that the expandable sleeve components and conventional sleeve components are staggered within the well bore and thus the time during which the well bore has reduced integrity is minimised.

Preferably the one or more expandable sleeve component comprises one or more expandable liner. Although both expandable casings and liners could be employed within the same well bore, preferably each of the one or more expandable sleeve components comprises an expandable liner.

The one or more expandable liners can be overlapped by either a conventional casing or liner.

Conventional liners are anchored to a previous sleeve component via a so called liner hanger. A liner hanger can be a circular metal double acting wedge or any other device that anchors the liner to a previous sleeve component. The liner hanger should also provide a sealing function to the connection between the liner and previous sleeve component, preferably metal to metal sealing. As the liners are located at differing depths within the well bore each liner will be hung from a separate liner hanger and the liner hangers will be located at differing depths within the well.

Casings on the other hand are hung from one or more casing hangers situated within the well head. This component is traditionally placed within the well head and is used to support the casings which have a diameter smaller than the well head. Casings such as the surface casing and conductor casing, which are positioned in the well bore either before or at the same time as the well head, do not require casing hangers. Instead these are simply cemented in place or, in the case of the surface casing, fixed to the well head by other means, for example bolting or welding.

Anchoring of expandable liners is provided by the deformation of the expandable liner until there is a forced fit of the expandable liner and the previous sleeve component. It is preferred that the previous sleeve component is provided with a recess shoe, i.e. the previous sleeve component has a main section and an end section with an enlarged diameter. This ensures that the expandable liner, in its expanded state, has the same inner diameter as the main part of the previous sleeve component. It is preferred that the expandable liner has a constant diameter throughout its length when expanded although this too can be provided with a recess shoe if desired.

The conventional (non expandable) liners and casings used in the present invention may comprise pre-made recess shoes into which the expandable liners can be expanded. Alternatively recess shoes may be created by reaming or other means once the non expandable sleeve component is installed within the borehole.

Although it is possible for one or more of the non expandable sleeve components to comprise casings, in a preferred embodiment the one or more expandable liner is overlapped by one or more conventional liner. In such an embodiment therefore, aside from the surface casing and conductor, the remainder of the well bore can be cased entirely by liners.

As conventional liners are located at different depths within the well bore each liner will be hung to a previous sleeve component by a dedicated liner hanger, said liner hangers placed down-hole and at a distance from the well head. The expandable liners are attached to the conventional liners, preferably by recess shoes in the conventional sleeve components.

Therefore, using a plurality of liners within the well bore dispenses with the need for a casing hanger within the well head. Dispensing with the casing hanger and instead using liner hangers at a distance from the well head allows a narrower well head to be created as room is not required to house the casing hanger. This in turn enables a smaller surface casing to be used, which can sustain a much higher pressure than the traditional 20" surface casing. In addition, greater available space is provided within the well head.

Therefore, in this preferred embodiment the subsurface well bore does not comprise a casing hanger within the well head. In other words, in this preferred embodiment of the invention there is provided a subsurface well bore comprising a plurality of liners, the plurality of liners comprising one or more expandable liners, each expandable liner being fully overlapped by one or more conventional liner such that the interior of the well bore is cased entirely by non expandable sleeve components, and wherein the well bore does not comprise a casing hanger.

In this preferred embodiment all sleeve components which, during well construction, are inserted through the well head are either expandable or non expandable liners. The well bore can comprise a conductor casing and the surface casing, however the remaining sleeve components take the form of either expandable or non expandable liners.

This embodiment of the present invention enables well bores to be constructed which incorporate, for example, five strings and maintain a large production tubing while using a well head diameter of under 12".

Preferably therefore the well bore comprises a well head having an internal diameter of less than 12". More preferably the well head has an internal diameter of 11½" and most preferably a diameter of 11". When the well bore is a sub sea well bore the internal diameter of the marine riser can be reduced in line with the well head diameter. All diameter measurements referred to are approximate and are intended to cover industrial tolerances, e.g. ±5%.

Preferably the well bore further comprises a surface casing having an internal diameter of 11¾". This can be larger than the well head as the surface casing is installed with or prior to the well head, and so does not need to be passed through the well head. However, it is desirable to keep this component narrow in order to reduce mud, casing and drill cutting volumes.

Any type of conventional and expandable liners can be used within the present invention.

In modern drilling it is often necessary for a relatively large production tubing to be run down the well bore to the reservoir. Preferably therefore the well bore further comprises a production tubing with an external diameter no more than 7⅝'. In some embodiments a 7" diameter production tubing is used.

Preferably, the well bore further comprises production tubing, the production tubing comprising a downhole safety valve (DHSV). When casings are used within the well bore, these extend into the well head and hence the DHSV of the production tubing will be situated within the narrowest casing section. In contrast, in the preferred embodiment of the present invention no casing hanger is present. Therefore it is possible for the DHSV to be located within the surface casing. This greater space enables a larger DHSV to be constructed which decreases the complexity of the component parts of the valve and eases manufacture and maintenance. In addition, there is a greater clearance between the DHSV and the interior wall of the surface casing. Downhole lines are run down this interior wall and can be damaged by the DHSV as this is inserted. A greater clearance reduces the likelihood of damage to these lines.

The increased room provided by this preferred embodiment of the present invention also allows more downhole control lines to be inserted and potentially also a small bore line for gas lift purposes.

In order to provide well engineers with enough flexibility to cope with different formation pressures during well bore creation it is preferable for the well bore to comprise up to five strings, wherein at least one string is an expandable liner. In a preferred embodiment two expandable liners are provided.

In a preferred embodiment the well bore comprises a well head having an 11" internal diameter, production tubing having a 7" external diameter and 5 sleeve components in the form of a surface casing, two conventional liners and two expandable liners. As mentioned above the conventional and expandable liners are preferably staggered within the bore hole. In some embodiments a 7⅝" diameter production tubing is used In some circumstances it will be desirable to use narrower production tubing, e.g. 5", and in such situations more liners may be included in the well bore while maintaining an 11" inner diameter well head.

The production tubing is supported within the well head by a tubing hanger. In preferred embodiments, in which no casing hanger is used, it is the tubing hanger which determines the required inner diameter of the well head, as this is now the largest component within the well head.

In addition to the production tubing, downhole lines are also run down the well bore. These carry signals to the surface relating to the operation of the well during reservoir extraction, e.g. pressure, temperature etc. The downhole lines are also used to carry signals for the control of production equipment, e.g. choke vales and DHSV. Moreover the downhole lines may also be used for injection of chemicals in to the reservoir and/or production tubing.

Conventionally, the various downhole lines are run through the annulus between the sleeve component wall and the production tubing, and are connected to the surface of the well via through holes within the tubing hanger body. The exiting lines are coupled to an external Xmas tree system. In order to provide space for these couplings, a tubing hanger suitable for 7" tubing must have an outer diameter of at least 11". This requirement therefore prevents further reduction in well bore diameter.

In one embodiment of the present invention, in order to reduce the diameter of the tubing hanger, the inventors have provided a novel well head design. In this embodiment of the present invention, the through holes for downhole lines are provided within the well head rather than the tubing hanger.

As the tubing hanger does not need to provide space for through holes and their associated mounting couplings, its diameter can be reduced, thus reducing the internal diameter of the well bore by several inches. The increased thickness of the well head caused by the reduction in its internal diameter ensures that its structural integrity is maintained despite the through holes within.

Therefore, when using the improved well head of the present invention, a well head having an internal diameter of under 11" can be used. Preferably the internal diameter of the well head is 10" and most preferably 9".

This improved well head is considered inventive in its own right and therefore, viewed from a further aspect the present invention comprises a subsurface well bore comprising a well head, a tubing hanger situated within the well head and a plurality of liners, wherein the subsurface well bore does not comprise a casing hanger within the well head and wherein the well head comprises through holes such that downhole lines can be passed through the well head.

In this aspect of the invention therefore the tubing hanger does not comprise through holes intended for receiving downhole lines. All the through holes required for downhole lines are located in the well head.

Preferably the well bore further comprises downhole lines connecting the interior of the well bore with the surface via the through holes of the well head. All the down hole lines pass through the well head and not through the tubing hanger. Preferably the through holes are attached to the tubing hanger within the well bore via penetrator couplings. Preferably mating couplers are provided to connect the downhole lines to an external Xmas tree system.

In order to obtain the benefits of the improved well head it is necessary that no casing hanger is used, as the required internal diameter of the well head is set by the casing hanger when this is present. Therefore those strings which are inserted into the well bore through the well head must be liners. The well bore can preferably comprise a plurality of liners including at least one expandable liner which is overlapped by one or more conventional liners as discussed above. Preferably the only casings used are installed prior to or together with the well head, e.g a conductor casing or surface casing. Preferably the conventional liners and expandable liners are staggered.

Preferably the method of the present invention is used to construct a well bore having the features discussed above.

In particular it is preferred that the non expandable sleeve component used in the method is a conventional liner and the expandable sleeve component is an expandable liner. Preferably no casing hanger is placed within the well head.

In one embodiment the method comprises the step of installing a well head together with or after insertion of a surface casing wherein all further sleeve components are inserted into the bore hole through said well head and comprise either expandable or conventional liners. Preferably the method further comprises passing downhole lines through the well head.

Embodiments of the present invention shall now be described, by way of example only, with reference to the accompanying drawings in which.

Figure 1:
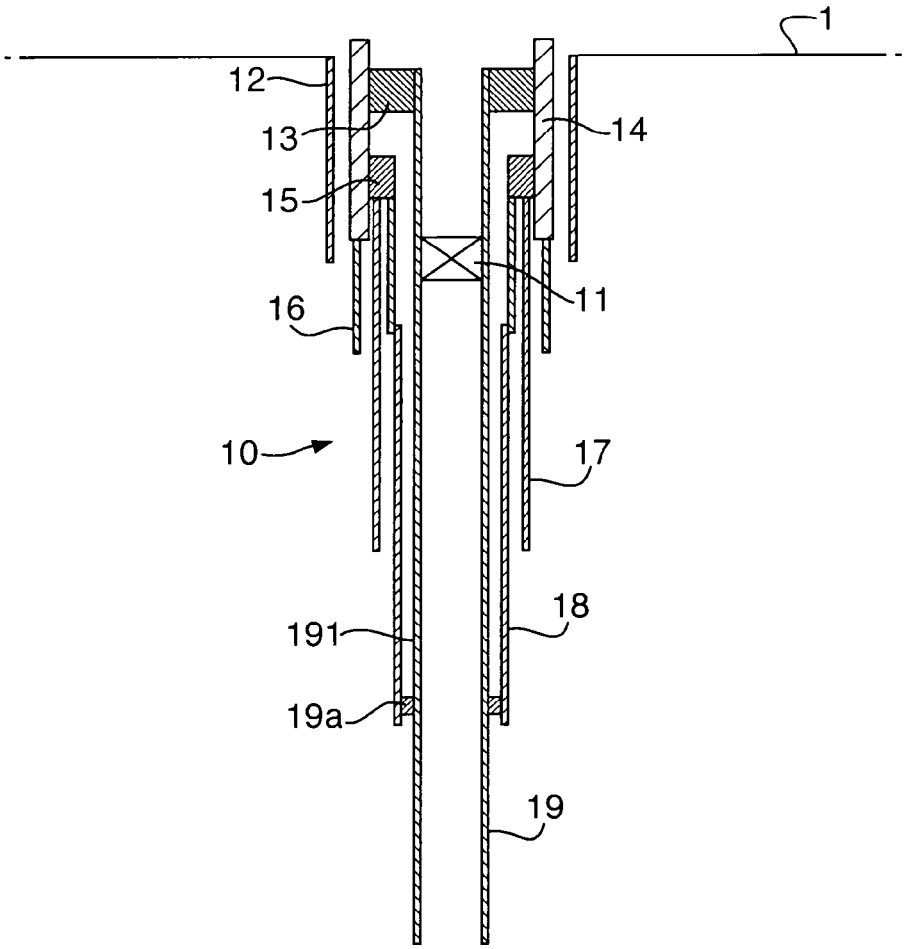
Fig.1. (Prior Art)
FIG. 1 shows a schematic representation of a prior art casing system.

FIG. 1 shows the construction of a well bore 10 in which traditional casing methods are used. At the surface 1, a conductor 12 is inserted into the first drilled section and cemented into place. This conductor 12 typically has a diameter of between 30 and 36 inches and acts as a support for drilling equipment during the rest of the bore hole creation. In addition this also serves to conduct drilling mud from the bottom of the hole to the surface once drilling starts. Situated within the conductor 12 is the surface casing 16. This is narrower in diameter than the conductor 12, typically approximately 20", and is intended to isolate fresh water zones such that these are not contaminated during drilling. The length of the surface casing 16 therefore depends on the area in which the well bore is being drilled.

Positioned on the surface casing 16 within the conductor 12, is the well head 14. The well head 14 extends above the ground, or seabed, in order to connect the well bore to a number of external components such as the Xmas tree and marine riser. The oil or gas retrieved from the reservoir will be transported through the marine riser from the well head 14 to a storage container on the ship or rig to which the riser is connected. The Xmas tree provides means for injecting chemicals or fluids into the well bore as well as valves and gauges for monitoring and controlling oil or gas extraction.

In order to drill further sections of the well bore the drill bit and drilling string are lowered into the bore 10 and drill through the surface casing 16 deeper into the ground. Drilling mud is pumped down through the drill string to the drill bit and up the annulus between the drill string and the bore hole in order to carry cuttings to the surface. Due to changes in formation pressure as the depth of the well is increased, it is normally necessary to case sections of the well as drilling progresses such that the hydrostatic pressure of the drilling fluid can be maintained between the formation pore and fracture pressures.

For example, an initial section of well bore may be drilled having a 13⅜" diameter. This is then cased by casing 17. After casing of this section drilling can now continue with a different hydrostatic pressure, but the newly drilled well bore must have a smaller diameter and hence this next section of the well bore will be cased with a narrower casing. In FIG. 1 second casing 18 has a first internal diameter of 10¾" and a second, main internal diameter of 9⅜". The part of the casing which provides support to the well bore has the second diameter whereas the wider section of casing 18 is located in the well head 14. This widened portion of casing 18 provides slightly more room within the well head for, e.g. downhole lines and valves. Casings 17, 18 extend into the bore hole from well head 14, where they are hung on casing hanger 15. Further, narrower sleeve components may be added as required until the oil reservoir is reached. All the casings located radially within the well head 14 are hung from casing hanger 15. The final section of well bore 10 is cased by liner 19. This is hung from the previous casing 18 by liner hanger 19*a*. After drilling and casing is complete, production tubing 191 is run through the well bore to the liner 19. This tubing 191 is typically around 7" in diameter with a 6" inner diameter. This width is necessary in order to allow reasonable extraction times. A production packer (not shown) seals the end of production tubing 191 and liner 19 from the annulus between tubing 191 and casing 18, In a similar way to casings 17,18 the production tubing 191 extends to the well head 14 where it is hung from tubing hanger 13. Downhole safety valve (DHSV) 11 forms part of the production tubing 191 and is used to close this tubing in the event of a blow out.

In the conventional systems of the type illustrated by FIG. 1, the inner diameter of the well head 14 is dictated by casing hanger 15. All the casings 17,18 passed through the well head during bore hole construction must be attached to this hanger 15 and therefore this has an outer diameter similar to that of the widest casing hung from it.

Figure 2:
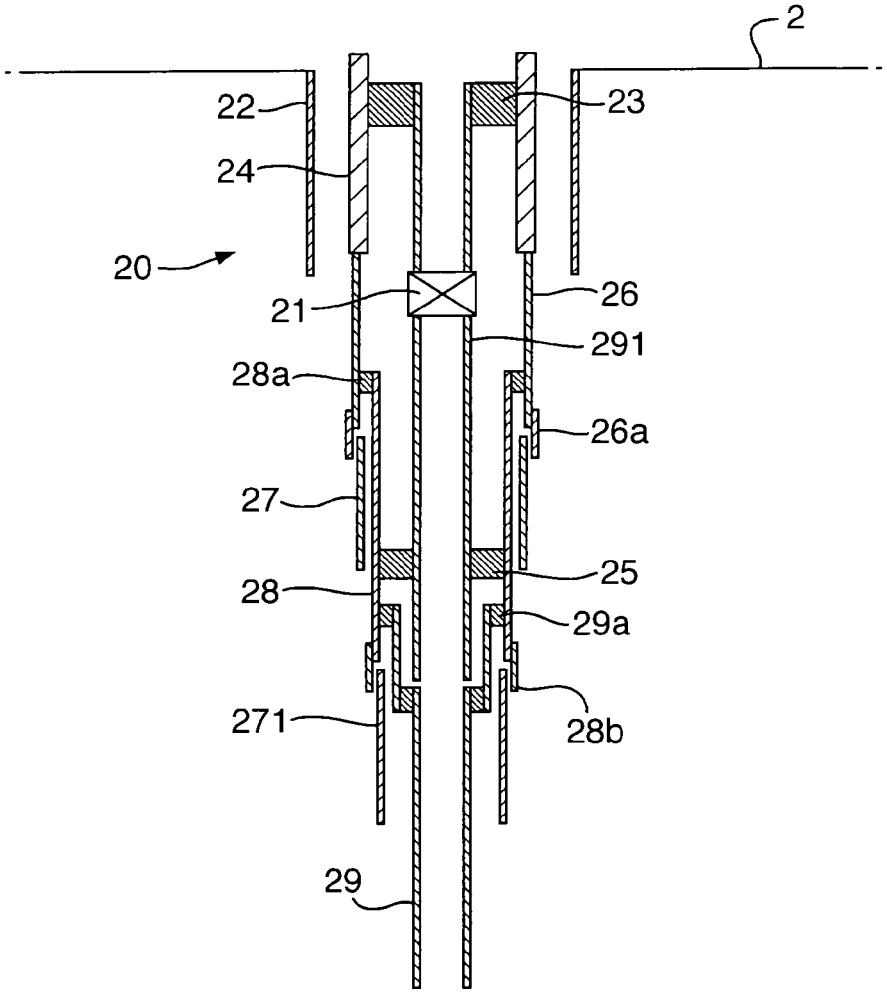
FIG. 2 shows a bore hole cased in accordance with the present invention.

FIG. 2 shows a bore hole 20 cased according to an embodiment of the present invention.

As is the case with prior art systems, a conductor 22 is initially installed and cemented. This conductor 22 has a standard width of 30 to 36". The diameter of the conductor 22 is not altered by the present invention and can vary depending on the requirements of the well.

A hole is then drilled through the base of the conductor 22 with a width suitable for housing surface casing 26 having an 11¾" diameter. Attached to this surface casing 26 is well head 24. The internal diameter of well head 24 is 11". This reduction in diameter enables a smaller marine riser to be used and hence provides great benefits in relation to high pressure systems as well as reducing mud volumes, drill cuttings and liner volumes.

This reduction in well head diameter is enabled firstly by removing the need for a casing hanger. After installation of the well head 24, all further sleeve components are liners. Liners, like casings, seal and support the bore hole and prevent liquid and gases from seeping into or out of the rock formations in which the bore hole 20 is drilled. However, unlike casings liners do not extend to the surface 2 of the bore hole 20 and instead extend to just above the base of a previous sleeve component, to which they are fastened.

Furthermore, in order to maintain the necessary diameter of the bore hole, expandable liners are used. Although, due to the deformable nature of expandable liners, these cannot be rated to full pressure integrity, these liners are useful during well bore construction. An expandable liner can be used to temporarily case a section of well bore during drilling of a later section, after which a conventional liner can be placed within the expandable liner to increase the pressure integrity of the well bore.

This is shown in FIG. 2. Surface casing 26 includes a pre-made recess shoe 26*a*. This shoe 26*a* is slightly wider in diameter than the remainder of the surface casing 26. After the next section of well bore has been drilled an expandable liner 27 is inserted. This liner 27 has an initial outer diameter of 9⅝". However, once this has been positioned within the well bore the liner 27 is expanded to a final diameter of 11¾", i.e. the same diameter as the surface casing 26. The expandable liner 27 expands into and forms an interference fit with recess shoe 26*a* of casing 26. However, in the Figure a slight gap has been shown between these two components for clarity. The expandable liner 27 is therefore held in position within the well bore 20.

Following the insertion and expansion of expandable liner 27 the next section of well bore can be drilled. As the liner has been expanded to the same diameter as surface casing 26, no change in drill bit size is required. After the next section of well is drilled a conventional liner 28 is hung from liner hanger 28*a*. This liner hanger 28*a* is located on surface casing 26, above the recess shoe 26*a*. Therefore, liner 28 extends from above expandable liner 27 to below this.

Liner 28 therefore cases the newly drilled well section and entirely overlaps the expandable liner 27. The expandable liner 27 can therefore be seen as a temporary liner as after installation of conventional liner 28, expandable liner 27 no longer forms part of the active casing.

Liner 28 can have a pre-made recess shoe or its base can be widened once in position downhole to create an expanded recess shoe 28*b*. Drilling then continues and a further expandable liner 271, having an initial diameter of 8", is inserted into the bore hole and expanded into recess shoe 28*b* of liner 28. The expanded diameter of liner 271 is 9⅝". Following the expansion of this liner 271 drilling can again continue and a liner 29 having a diameter of 7" or 7⅝" can be hung from lining hanger 29*a* from liner 28 such that this fully overlaps and extends past expandable liner 271.

Liner 29 is not uniform in diameter. The top section of this liner is slightly enlarged to allow production tubing 291 to enter the liner 29. This enlargement is exaggerated in FIG. 2 for clarity. The diameter then decreases to 7" or 7⅝", the same diameter as the production tubing 291. Production packer 25 is located above this interface to seal this against any potential leakage. Alternatively designated sealing can be positioned between the enlarged section of liner 29 and production tubing 291.

This allows a five string well bore to be created having a well head 24 with an internal diameter of 11" while still providing a 7" diameter production tubing 291. This production tubing 291 extends down the length of the well bore to liner 29. The production tubing 291 is hung within well head 24 by tubing hanger 23. By casing the well bore using liners no casing hanger is required and so the downhole safety valve 21 of production tubing 291 can be located inside the 11¾" surface casing 26. This increased room allows the DHSV 21 to be larger and for more downhole control lines to be inserted and potentially also a small bore line for gas lift purposes.

Figure 3:
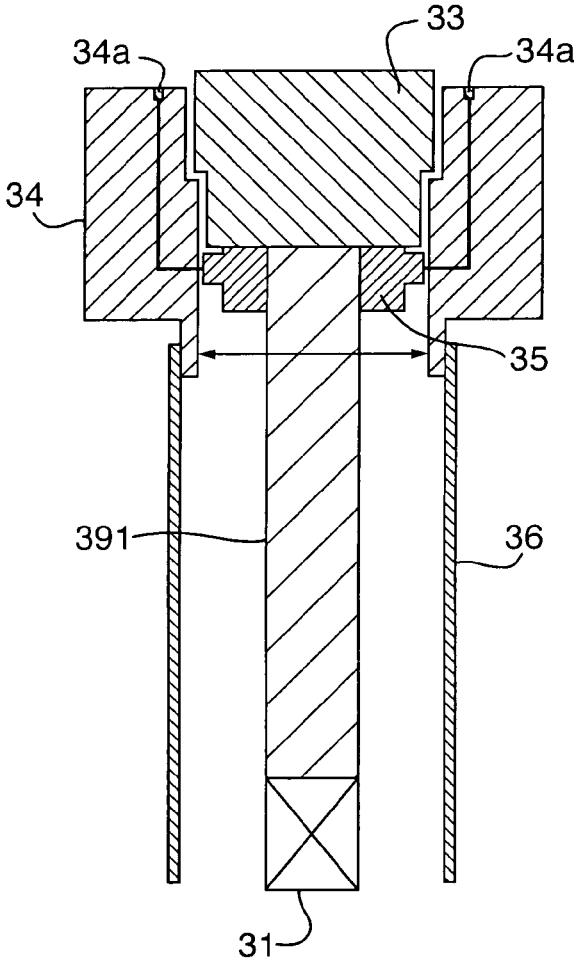
FIG. 3 shows an improved well head in accordance with one aspect of the present invention.

FIG. 3 shows a preferred embodiment of the present invention in which well head 34 comprises through holes 34*a* through which downhole control lines can be fed. Although only two holes are shown in FIG. 3, more can be positioned at angular intervals around the central bore. In conventional systems these control lines are fed through the tubing hanger 33 into the annulus between the casing wall 36 and production tubing 391. This requires the tubing hanger 33 to have a suitably wide diameter to enable machining of through holes and the attachment to the associated Xmas tree couplings. By removing this requirement from the tubing hanger 33, the diameter of this component can be reduced, allowing a similar reduction in the internal diameter of the well head 34. The increased thickness of the well head 34 increases the strength of this component and hence its structural integrity is maintained despite through holes 34*a*. Removing the through holes from the tubing hanger 33 and placing these within well head 34 allows the internal diameter of the well head 34 to be reduced to 9".

The downhole lines are fed through holes 34*a* and connected to the tubing hanger 33 by penetrater couplings 35. At the surface of the well head 34 vertical couplings can connect the exiting downhole lines to the Xmas tree in a similar way as was previously achieved between the Xmas tree and the tubing hanger 33.

The surface casing 36 has a diameter of 11¾" and therefore the downhole sections of the well bore (not shown) can be identical to that shown in FIG. 2.

However, narrower liners can also be used in certain situations.

Two casing methods are outlined below.

7" Completion

A 36" or 42" hole is drilled on the seabed and a 30" or 36" conductor is installed and cemented. A suitable hole is then drilled for 11¾" surface casing with a pre-made recess shoe. The 11¾" surface casing and attached 11" well head is installed and cemented.

A hole is drilled out of the surface casing and reamed up to the necessary diameter for installing a 9⅝"×11¾" expandable liner. The liner is run and expanded out of the recess shoe of the surface casing. The expandable liner is cemented if necessary. A hole is then drilled out of the expanded 9⅝"×11¾" section and reamed up to a suitable diameter for installing a 9⅜" liner. The 9⅜" liner is run and hung off in the lower end of the surface casing, above the recess shoe, thus overlapping (covering) the 9⅜"×11¾" expandable liner. This is then cemented and the lower end of the 9⅜" liner is expanded downhole to create a recess shoe.

A hole is drilled out of the 9⅜" liner and reamed to a suitable size for a 7⅝"×9⅜" expandable liner. The 7⅝"×9⅜" expandable liner is run and expanded out of the recess shoe of the previous 9⅜" liner. A hole is drilled and reamed (if necessary) up to a suitable dimension for installing a 7" or 7⅝" liner. This liner is run and hung off in the lower end of the first (conventional) 9⅜" liner, above the expanded recess shoe, thus overlapping (covering) the 7⅝"×9⅜" expandable liner. This final liner is cemented if necessary.

The well is now ready for completion with 7" production tubing. The DHSV is located in the 11¾" surface casing.

5½" Completion

This follows the same steps as above until the installation of the 7" or 7⅝" liner. After installation, a hole is drilled out of this liner and reamed to a suitable size for a 5" or 5½" liner. The liner is run and hung off in the lower end of the previous liner section and cemented if applicable. This well is now ready for completion with 5½" production tubing. Once again the DHSV is located in the 11¾" surface casing.

By using a 9" improved well head comprising through holes the well bore and sleeve component diameters could be reduced further.

Therefore, the present invention enables small bore wells to be created without reducing production tubing diameter. It will be appreciated that the embodiments described above are preferred embodiments only of the invention. Thus various changes could be made to the embodiments shown which would fall within the scope of the invention as defined by the claims. For example, the bore hole casing could consist of only one expandable liner or the improved well head shown in FIG. 3 could be used in a casing system which does not involve expandable liners.

The invention claimed is:

1. A subsurface well bore arrangement comprising a well bore and one or more expandable liners, an interior of each expandable liner being fully overlapped by one or more non-expandable sleeve components such that an interior of the well bore arrangement is cased entirely by said one or more non-expandable sleeve components, so as to support an interior wall of the well bore, wherein the one or more non-expandable sleeve components are conventional casings and/or conventional liners, and wherein each of the one or more expandable liners is hung from one of the one or more non-expandable sleeve components.

2. The subsurface well bore arrangement as claimed in claim 1, wherein each expandable liner is overlapped by a different non-expandable sleeve component.

3. The subsurface well bore arrangement as claimed in claim 1, wherein the subsurface well bore does not comprise a casing hanger and the one or more expandable liners are overlapped by one or more conventional liners.

4. The subsurface well bore arrangement as claimed in claim 3, further comprising a well head having an internal diameter of under 12".

5. The subsurface well bore arrangement as claimed in claim 4, wherein the well head has an internal diameter of 11".

6. The subsurface well bore arrangement as claimed in claim 3, further comprising a well head having an 11" internal diameter, production tubing having a 7" external diameter and a surface casing, two conventional liners and two expandable liners.

7. The subsurface well bore arrangement as claimed in claim 1, wherein the non-expandable sleeve components comprise a surface casing and one or more conventional liners.

8. The subsurface well bore arrangement as claimed in claim 1, wherein the well bore further comprises production tubing with an external diameter of 7".

9. The subsurface well bore arrangement as claimed in claim 1, further comprising a surface casing having an internal diameter of 11¾".

10. The subsurface well bore arrangement as claimed in claim 1, further comprising a surface casing and production tubing, the production tubing comprising a down hole safety valve located within the surface casing.

11. The subsurface well bore arrangement as claimed in claim 1, further comprising a well head in which through holes are provided through which downhole lines can be passed.

12. The subsurface well bore arrangement as claimed in claim 11, further comprising a tubing hanger, said tubing hanger not comprising any through holes arranged for receiving down hole lines.

13. The subsurface well bore arrangement as claimed in claim 11, further comprising the downhole lines, the downhole lines connecting the interior of the well bore with the surface via the through holes of the well head.

14. The subsurface well bore arrangement as claimed in claim 11, wherein the well head has an internal diameter of less than 10".

15. The subsurface well bore arrangement as claimed in claim 1, wherein each expandable liner has an outer diameter, when unexpanded, smaller than that of said one of the one or more non-expandable sleeve components from which each expandable liner is hung.

16. A subsurface well bore comprising:

a well head;

a surface casing extending from the well head, the surface casing being provided with a first recess shoe, the first recess shoe having a wider diameter than the remainder of the surface casing;

a first expandable liner configured to be expanded into the first recess shoe of the surface casing;

a first non-expandable sleeve component attached to the surface casing at a location above the first recess shoe of the surface casing, and extending over an entire length of the first expandable liner, the first non-expandable sleeve component being provided with a second recess shoe, the second recess shoe having a wider diameter than the remainder of the first non-expandable sleeve component;

a second expandable liner configured to be expanded into the second recess shoe of the first non-expandable sleeve component; and a second non-expandable sleeve component, different from the first non-expandable sleeve component, attached to the first non-expandable sleeve component at a location above the second recess shoe of the first non-expandable sleeve component, and extending over an entire length of the second expandable liner, wherein the interior of the well bore is cased entirely by the first and second non-expandable sleeve components.

* * * * *